United States Patent [19]

Firth, III et al.

[11] 4,213,575

[45] Jul. 22, 1980

[54] PRINTER RIBBON SUPPLY MECHANISM WITH END OF RIBBON DETECT EXPEDIENT WHICH REDUCES RIBBON DRAG

[75] Inventors: Rowland V. D. Firth, III; Willie Goff, Jr., both of Austin, Tex.

[73] Assignee: International Business Machines Corporation, Armonk, N.Y.

[21] Appl. No.: 958,212

[22] Filed: Nov. 6, 1978

[51] Int. Cl.[3] ..... B41J 35/36; B65H 25/30

[52] U.S. Cl. ..... 242/57; 242/191; 400/219.2; 400/249

[58] Field of Search ..... 242/57, 191, 71, 189, 242/190, 55; 400/249, 219.2, 219.1, 219, 583

[56] References Cited

U.S. PATENT DOCUMENTS

| | | | |
|---|---|---|---|
| 578,919 | 3/1897 | Felt | 400/219.2 |
| 2,304,216 | 12/1942 | Thompson | 400/219.2 |
| 2,760,024 | 8/1956 | Tunstall | 200/61.15 |
| 2,954,940 | 10/1960 | Herrmann | 242/57 |
| 3,048,254 | 8/1962 | Morris | 400/192 |
| 3,112,020 | 11/1963 | Bishop | 400/244 |

FOREIGN PATENT DOCUMENTS

| | | | |
|---|---|---|---|
| 381438 | 9/1923 | Fed. Rep. of Germany | 400/219.2 |

*Primary Examiner*—George F. Mautz
*Attorney, Agent, or Firm*—J. B. Kraft

[57] ABSTRACT

In a conventional ribbon supply spool structure which comprises a supply of ribbon wound on a hub rotatable about and axially movable with respect to a hub receiving member on which the hub is seated and which is coaxial with respect to the hub, an improved end of ribbon detection device is provided by the combination of deflectable spring means within the spool hub which exert a force when deflected having a first force component acting against but restrained by wound ribbon on the hub and a second component acting along the hub axis. A spring tensioned member exerts a force along the hub axis which opposes the component of force of the deflectable spring along the hub axis. In this manner, the deflectable spring and the spring tensioned member are maintained in static equilibrium at a selected point along said axis so long as the deflectable spring is restrained by a predetermined minimum of ribbon remaining wound on the hub. This predetermimned minimum of ribbon remaining wound is indicative of the end of ribbon. In the preferred embodiment this is in effect the point where the ribbon becomes substantially unwound.

4 Claims, 2 Drawing Figures

PRINTER RIBBON SUPPLY MECHANISM WITH END OF RIBBON DETECT EXPEDIENT WHICH REDUCES RIBBON DRAG

BACKGROUND OF THE INVENTION

1. Field of the Invention

This invention relates to impact printers. More specifically, it relates to ribbon feed or supply mechanisms in such impact printers.

2. Description of Prior Art

With the development of the printer field in the direction of high speed impact printers producing high quality printing suitable for correspondence at high speed in the order of 60 cycles per second, new needs have arisen with respect to printer ribbon structure and feed mechanism.

Because of the high throughput of such printer apparatus and the consequently high volume of printed characters, the art has had to provide a ribbon which is of relatively low cost but yet provides high quality printing. Because of the difficulty in meeting these requirements with the more traditional fabric base or carbon film ribbons, the art has been working with a more recent type of ribbon which is a cast matrix of a plastic such as nylon containing liquid ink. While such ribbon structures appear to provide the combination of high quality printing and low cost, they are highly flexible and fragile. Further, they are sensitive to high temperature and high humidity. For example, at temperatures in the order of 25° C. and 80% relative humidity, as little as 30 grams of ribbon tension may cause objectionable yielding and frequent breakage of a cast matrix type of ribbon which is in the order of 0.6 cm. wide.

It consequently becomes very important that the ribbon supply and feed system be operated as free as possible of "drag" of friction acting against the ribbon as it is being removed from the supply spool and fed towards the printer impact point.

Another critical aspect involved in the use of the relatively fragile film type ribbons in high speed printing is that of end of ribbon sensing. The reason for this criticality is that because of the fragile nature of such ribbons, it is necessary to use both ribbon leaders and ribbon trailer of reinforcing but not printable materials in order to avoid ribbon breakage during manufacturing loading and unloading. In a high speed printing operation of the type described, inaccuracies in end of ribbon sensing can often lead to the nonprinting ribbon follower being fed into the print position for up to several characters before the end of the ribbon is finally sensed. This of course is unacceptable in high speed printing apparatus as it leads to nonprinted characters, a condition which is difficult if not totally impractical to remedy.

BRIEF DESCRIPTION OF PRESENT INVENTION

As will be seen hereinafter, the present invention provides ribbon supply apparatus which solves both of the above mentioned problems by a simple inexpensive device.

In this respect, it is the primary object of the present invention to provide ribbon supply apparatus in which ribbon "drag" is minimized.

It is another object of the present invention to provide ribbon supply apparatus having highly accurate end of ribbon sensing means.

It is a further object of the present invention to provide ribbon supply apparatus in which accurate end of ribbon sensing as well as ribbon "drag" minimization is provided through a simple inexpensive device.

The combination of expedients of the present invention is provided in a conventional ribbon supply spool structure which comprises a supply of ribbon wound on a hub rotatable about and axially movable with respect to a hub receiving member which is coaxial with the hub. The present combination which is incorporated into this conventional structure comprises deflectable spring means within said spool hub exerting a force when deflected having a first component of force acting against and restrained by said wound ribbon and a second component acting along said hub axis, and a spring tensioned member exerting a force along said hub axis in opposition to said deflectable spring, whereby said deflectable spring and said spring tensioned member are maintained in static equilibrium at a point along said axis so long as said deflectable spring is restrained by a predetermined minimum of ribbon remaining wound on said hub.

The spring forces involved in the deflectable spring means as well as the spring tension member are preferably selected so that the equilibrium point will be sufficiently high on the axis that ribbon spool will be lifted away from the bottom of the hub receiving member to the point that contact between the bottom of the wound ribbon and the bottom of the hub receiving member will be minimized and thus fricton between these two elements or "drag" will be minimized.

In addition, it is preferable that the above-mentioned predetermined minimum of wound ribbon capable of restraining and deflectable spring means within the spool hub be reached only when substantially all of the ribbon is unwound from the hub. Thus, the deflectable spring with release point is only reached after all the ribbon is substantially unwound.

When the unwinding of the ribbon releases the deflectable spring, the opposing spring tension member which is now free to move along the axis to actuate an associated switch indicating the end of the ribbon.

BRIEF DESCRIPTION OF THE DRAWINGS

Referring now to the drawings, wherein a preferred embodiment of this invention is illustrated, and wherein like reference numerals are used throughout to designate like parts.

DESCRIPTION OF THE PREFERRED EMBODIMENT

Figure 1:
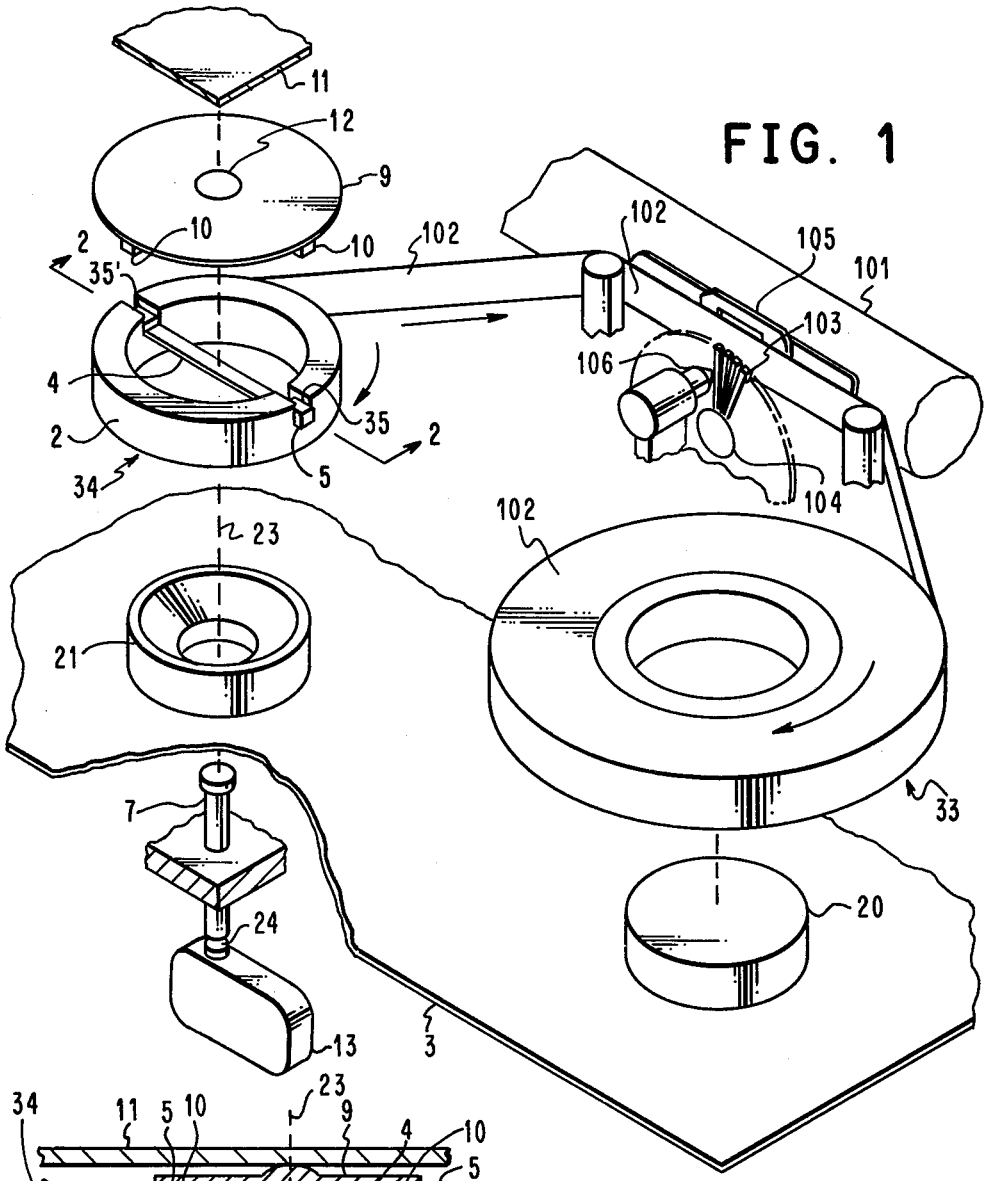
FIG. 1 shows a partial fragmentary perspective view of the ribbon feed apparatus of a high speed printer in which the ribbon supply apparatus of the present invention is shown with its component parts separated along the axis of rotation of the supply spool.

With reference to FIG. 1, that portion of a printer apparatus necessary to illustrate the present invention is shown. In conventional apparatus the ribbon 102 is moved past a platen 101 having conventional means 105 for supporting a sheet of paper (not shown) between the ribbon 102 and the platen 101. A conventional print wheel 104 containing petals 103 each with a different character to be printed is rotatable between the ribbon 102 and impact means 106 which may be a hammer or missile. In the conventional manner, print wheel rotates to the selected character whereupon the impact means 106 are fired driving the petal and the adjacent ribbon into the printing medium. The device of the present invention may be used in connection with any standard ribbon supply system. For purposes of illustration of this embodiment, a ribbon cartridge supply and take-up means will be utilized. Shown fragmentarily in FIG. 1, it comprises a cartridge bottom plate 3 having a core 20 for receiving the ribbon take-up spool and a core 21 for receiving the ribbon supply spool. The ribbon take-up spool 33 is rotated in the direction shown about core 20 by drive means (not shown) which may conveniently be drive means engaging the periphery of ribbon 102 to rotate the ribbon in the direction shown.

Figure 2:
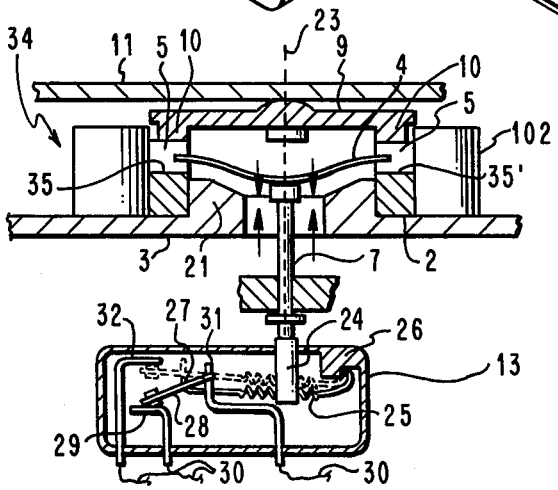
FIG. 2 is a diagrammatic cross-sectional view of the supply spool portion of the apparatus of FIG. 1 taken along line 2—2 with the component parts assembled and a full supply of ribbon wound on the spool.

The expedient of the present invention will now be described with respect to the separated perspective view in FIG. 1 and the cross-sectional view in FIG. 2. Ribbon 102 is normally wound on hub 2 which is normally seated on a hub receiving member made up of the combination of core 21 and cartridge bottom plate 3. Ribbon hub 2 is coaxial with core 21 and freely rotatable about core 21 and axis 23. Thus, the combination of core 21 and cartridge bottom plate 3 make up a ribbon hub receiving member which provides for the location and bearing of the ribbon supply spool 34 made up of said hub and wound ribbon. A pair of slots 35 and 35' are formed in the upper surface of hub 2. Deflectable spring member 4 is seated in slots 35 and 35'. This deflectable spring has a pair of molded guide members 5 at each end thereof which support the spring in slots 35 and 35'. When the ribbon is substantially unwound from hub 2 as shown in FIG. 1, guide members 5 are permitted to protrude laterally from slots 35 and 35' and deflectable spring 4 is fully distended. On the other hand, when ribbon 102 is wound on hub 2, as shown in FIG. 2, spring member 4 is deflected inwardly and downwardly in the direction shown by the arrows. This downward spring force is opposed by an upward spring force provided by the spring member of a conventional microswitch 13. Microswitch 13 is so positioned along the axis 23 that when deflectable hub spring 4 is deflected through the presence of ribbon, the downward force of this spring will be opposed by a switch actuation pin 7 acting on switch handle 24 which is tensioned upward by deflected switch spring 25. This switch spring is mounted with one end on the switch housing 26 and the other end 27 engaging switch contact 28 which is pivotably mounted about pivot point 31.

When deflectable hub spring 4 is restrained and deflected by the presence of ribbon 102 in FIG. 2, the deflected spring manifests two components of force: the first is a lateral force acting outwardly through slot 35 and 35' to press guide members 5 against ribbon 102 which restrains spring 4 laterally. As previously mentioned the downward component of force of hub spring 4 is opposed by the upward component of force of spring 25 in microswitch 13. The latter upward spring force is transmitted through switch handle 24 which engages spring 25 and actuation pin 7 in the upward direction shown by the arrows. Relative axial components of spring tension of spring 4 and microswitch 25 are selected so that as long as there is ribbon on ribbon hub 2, there will be an equilibrium point along axis 23 whereat hub 2 and ribbon 102 are lifted sufficiently from a frictional engagement of the bottom of the wound ribbon 102 with the bottom plate of the cartridge 3 that "drag" or frictional engagement between the bottom of the wound ribbon and plate 3 are minimized. In this connection, it should be noted that spool cover 9 which is pressed into engagement with hub 2 in order to hold the ribbon in place vertically has projections 10 which extend into slots 35 and 35' to restrain any movement of deflected hub spring 4 in the upward direction. Cartridge top 11 is placed in such a position that some minute vertical movement of core 2 is permitted in the reduction of ribbon "drag" resulting from the preferred spring equilibrium point described above.

While we have considered primarily the opposing vertical components of force of spring members 4 and 25 in determining the equilibrium point, when the ribbon structure is arranged along an up and down or vertical axis as shown in the embodiment, the weight of the ribbon spool assembly including hub 2, the wound ribbon 102 itself and spool cover 9 must be considered in conjunction with the downward component of force of hub spring 4 in determining the total downward force which must be opposed by the upward force of switch spring 25 in determining the equilibrium point. Of course, if the spool axis were rotated 90° so that a lateral equilibrium point were being considered in the particular equipment involved, then weight would not be a factor and the equilibrium point would be determined primarily by the opposing spring forces.

In any event, at this equilibrium point, the deflected microswitch spring 25 urges switch contact 28 into engagement with contact 29 whereby an indication is sent through switch leads 30 indicating that the "end of ribbon" has not been reached. However, as the ribbon is unwound when it is being used during the printing operation, a point is reached when the minimum amount of ribbon capable of laterally restraining deflective hub spring 4 is reached. While in the preferred embodiment as shown in FIGS. 1 and 2, this point is not reached until all of the ribbon is substantially unwound from hub 2 freeing guides 5 in slots 35 and 35', it should be noted that this minimum restraining point may be selected, dependent on the nature of the ribbon as well as the lateral component of force of deflected spring member 4. Consequently, this minimum point which indicates end of ribbon may be sensed while two or three turns of ribbon are still wound about the hub.

When spring member 4 is no longer restrained laterally, the downward component of force of the spring is released permitting spring member 25 to move upwardly to the position shown by the dotted lines. As a result both switch handle 24 and switch actuation pin 7 are moved upwardly and contact 28 is permitted to pivot about pivot point 31 to engage contact 32 as shown in the dotted lines which produces a signal through contact lines 30 that the end of ribbon has been reached.

While the invention has been particularly shown and described with reference to a particular embodiment, it will be understood by those skilled in the art that various changes in form and detail may be made without departing from the spirit and scope of the invention.

What is claimed is:

1. In a ribbon supply spool structure comprising a supply of ribbon wound on a hub rotatable about and axially movable with respect to a hub receiving member coaxial with said hub, the combination of:

deflectable spring means within said spool hub exerting a force when deflected having a first component of force acting against and restrained by said wound ribbon and a second component acting along said hub axis, and a spring tensioned member exerting a force along said hub axis in opposition to said deflectable spring means, whereby said deflectable spring means and said spring tensioned member are maintained in static equilibrium at a point along said axis so long as said deflectable spring means is restrained by a predetermined minimum of ribbon remaining wound on said hub, and the axial position of said hub with respect to said hub receiving member at said equilibrium point is such that friction between said hub and said hub receiving member is minimized.

2. The ribbon supply spool structure of claim 1 wherein said predetermined minimum is reached when substantially all ribbon is unwound from said hub.

3. The ribbon supply spool structure of claim 2 wherein the hub axis is a vertical axis and said spring tensioned member opposes the weight of the spool hub and the wound ribbon in addition to the force of the deflectable spring means along the vertical axis in urging said hub toward said equilibrium point.

4. The ribbon spool structure of claim 2 further including a switch actuatable to indicate the end of ribbon when the spring tensioned member moves axially upon the release of said deflectable spring means by the unwinding of said ribbon.

* * * * *